US005343812A

United States Patent [19]

Ishida

[11] Patent Number: 5,343,812

[45] Date of Patent: Sep. 6, 1994

[54] TRAIN OF ARTICULATED VEHICLES

[75] Inventor: Takeshi Ishida, Kobe, Japan

[73] Assignee: Kawasaki Jukogyo Kabushiki Kaisha, Hyogo, Japan

[21] Appl. No.: 957,110

[22] Filed: Oct. 7, 1992

[30] Foreign Application Priority Data

Oct. 16, 1991 [JP] Japan ..... 3-267578

[51] Int. Cl.[5] ..... B61D 49/00

[52] U.S. Cl. ..... 105/4.3; 105/3

[58] Field of Search ..... 105/3, 4.1, 4.3; 410/53; 280/408

[56] References Cited

U.S. PATENT DOCUMENTS

| | | | |
|---|---|---|---|
| 1,754,111 | 4/1930 | Latshaw | 105/4.1 |
| 2,132,001 | 10/1938 | Dean | 105/4.1 X |
| 2,155,615 | 4/1939 | Rice | 105/4.1 |
| 2,865,306 | 12/1958 | Bock et al. | 105/3 |
| 4,942,824 | 7/1990 | Cros . | |

FOREIGN PATENT DOCUMENTS

| | | | |
|---|---|---|---|
| 473036 | 2/1929 | Fed. Rep. of Germany . | |
| 664933 | 9/1938 | Fed. Rep. of Germany | 105/4.3 |
| 688777 | 3/1940 | Fed. Rep. of Germany | 105/4.3 |
| 1180392 | 10/1964 | Fed. Rep. of Germany . | |
| 245610 | 3/1966 | Fed. Rep. of Germany | 105/4.3 |
| 324559 | 4/1936 | Italy | 105/4.3 |
| 58-39558 | 3/1983 | Japan . | |
| 63-279966 | 11/1988 | Japan . | |
| 329987 | 6/1958 | Switzerland | 105/4.1 |
| 371475 | 10/1963 | Switzerland . | |

*Primary Examiner*—Robert J. Oberleitner
*Assistant Examiner*—S. Joseph Morano
*Attorney, Agent, or Firm*—Oliff & Berridge

[57] ABSTRACT

A train of articulated vehicles which can be disassembled and assembled readily and to which an articulation mechanism of any conventional structure can be applied universally. A plurality of receiving side vehicle bodies each having one or a pair of receiving side articulating portions and a plurality of received side vehicle bodies each having one or a pair of received side articulating portions are disposed alternately. An articulating truck is disposed at each of the first and last ends of the train and also between each adjacent ones of the receiving and received side vehicle bodies. At the position of each articulating truck, a received side articulating portion of the received side vehicle body is received on a receiving side articulating portion of the receiving side vehicle body which is in turn mounted on the articulating truck. Thus, each received side vehicle body is received on and connected to a pair of receiving side vehicle bodies, and consequently, the train can be separated into three groups by lifting and disassembling only a necessary one of the received side vehicle bodies.

8 Claims, 7 Drawing Sheets

TRAIN OF ARTICULATED VEHICLES

BACKGROUND OF THE INVENTION

1. Field of the Invention

This invention relates to the formation of a train of articulated vehicles wherein a truck is shared by two adjacent vehicle bodies, and more particularly to a train of articulated vehicles wherein an articulation mechanism between adjacent vehicle bodies can be disassembled and assembled readily from and into the formation of the train.

2. Description of the Related Art

A plurality of vehicle bodies of railroad vehicles or the like are conventionally coupled into a train in various forms. An exemplary one of the coupling forms is a train of articulated vehicles wherein two adjacent vehicle bodies are carried on a common truck placed intermediately between them. Such articulation mechanism is disclosed, for example, in Japanese Patent Laid-Open Applications Nos. 58-39558, 63-279966 and 2-20474.

The prior art articulation mechanisms have a common feature that a first one of two adjacent vehicle bodies is placed on a truck and the second vehicle body is placed on the first vehicle body placed on the truck. Accordingly, the first vehicle body positioned on the lower side cannot be disassembled unless the second vehicle body on the upper side is removed. In other words, there is a restriction in the disassembling and disassembly procedure of the articulated vehicles.

FIG. 7 shows a train having the formation of five vehicles wherein the vehicle bodies are articulated by means of any of the prior art articulation mechanisms. Referring to FIG. 7, reference numerals 1 to 5 each surrounded by a circle represent numbers of the individual vehicle bodies in order from the top in the formation of a train, that is, what vehicle numbers the individual vehicle bodies have. The first vehicle (1) is supported at the leading end thereof on a truck 11 for the exclusive use for the vehicle body (1) and has at the trailing end thereof an articulating portion 12 for the coupling to the second vehicle (2). The articulating portion 12 is positioned on the lower side of another articulating portion 14 at the leading end of the second vehicle (2), and the first and second vehicles (1) and (2) are coupled to each other at and by the articulating portions 12 and 14. The articulating portion is coupled to an articulating truck 13 provided commonly for the first and second vehicles (1) and (2), and the first and second vehicles (1) and (2) are supported on the truck 13. Since the articulating portion 14 of the second vehicle (2) is received and supported on the articulating portion 12 of the first vehicle (1), the articulating portion 12 is hereinafter referred to as s receiving side articulating portion 12 while the other articulating portion 14 is hereinafter referred to as a received side accumulating portion 14.

Each of the second to fourth vehicles (1) to (4) has s received side articulating portion 14 at the leading end thereof and has at the trailing end thereof a receiving side articulating portion 12 which is coupled to a truck 13, and the fifth vehicle (5) at the last end of the train has a receiving side articulating portion 12 at the leading end thereof and has at the trailing end thereof a truck 11 for the exclusive use which is similar to that at the leading end of the first vehicle (1). The articulating portions 12 and 14 are coupled in such a manner as described above.

The train of the construction described above has an articulation construction wherein the leading end of a vehicle is received on the trailing end of another preceding vehicle in such a manner that the leading end of the second vehicle (2) is received on the trailing end of the first vehicle (1), and the third vehicle (3) is received on the trailing end of the second vehicle (2).

However, since the articulating construction is such as described above, when a vehicle only at a required position of the train is to be taken out for the maintenance OF the formation of the train is to be modified at a required position thereof, it is necessary to follow a fixed procedure upon disassembling and assembling the articulating portions at the position. In short, normally the vehicles of the train must be disassembled successively beginning with the fifth vehicle body at the last end of the train, and then, they must be assembled in the reverse order. Consequently, when it is, for .example, to disassemble only the second vehicle, first the front portion of the third vehicle is lifted and the first and second vehicles are moved away from the third vehicle. Then, the front portion of the third vehicle body is placed on a suitable support, and the truck at the trailing end of the second vehicle is disassembled from the second vehicle, whereafter the front portion of the second vehicle is lifted to disassemble the second vehicle from the first vehicle. Thus, except when the fifth vehicle body at the last end of the train is to be disassembled, it cannot be avoided to touch with an adjacent vehicle.

Further, if the front portion of the third vehicle is lifted strain is produced at the coupling at the rear portion of the third vehicle. After all, in most cases, it is necessary to disassemble the third and following vehicle bodies from each other in advance, and from this fact, it is estimated that disassembly and assembly of articulated vehicles are difficult.

SUMMARY OF THE INVENTION

It is an object of the present invention to provide a train of articulated vehicles which can be disassembled and assembled readily.

It is another object of the present invention to provide a train of articulated vehicles to which an articulation mechanism of any structure as represented by the prior art articulation mechanism can be applied universally.

In order to attain the object, according to the present invention, there is provided a train of articulated vehicles, which comprises a plurality of receiving side vehicle bodies each having at least one receiving side articulating portion, a plurality of received side vehicle bodies each having at least one received side articulating portion and disposed alternately with the receiving side vehicle bodies to make up a train, and an articulating truck disposed at each of the first end and the last end of the first and last vehicle bodies of the train and also between each adjacent ones of the receiving and received side vehicle bodies, where a received side articulating portion of the received side vehicle body is received on a receiving side articulating portion of the receiving side vehicle body which is in turn mounted on the articulating truck.

In the train of articulated vehicles, the receiving side vehicle bodies each having one or a pair of receiving side articulating portions and the received side vehicle bodies each having one or a pair of received side articulating portions are disposed alternately in such a manner that, for example, the receiving side vehicle bodies are disposed at oddnumbered positions of the train, that is, as oddnumbered vehicle bodies and the received side vehicle bodies are disposed at even-numbered positions of the train as even-numbered vehicle bodies. Since each of the received side vehicle bodies is received on and connected to a pair of adjacent receiving side vehicle bodies at the front and rear positions of the received side vehicle body, if only necessary one of the received side vehicle bodies is lifted upwardly and disassembled .from the two adjacent receiving side vehicle bodies, then the train is separated into three groups including a train of the forward vehicle on vehicles, the disassembled received side vehicle body and another train of the rear vehicle or vehicles. When the formation of the train is to be modified, the vehicle bodies may be rearranged into another formation in this condition. On the other hand, when a vehicle body for which maintenance should be performed is a received side vehicle body, if the disassembled vehicle body is separated, then the train is divided into 3 groups, but when the vehicle body for which maintenance should be performed is a receiving side vehicle body, if the receiving side vehicle body and an adjacent one of the received side vehicle bodies are separated, the train is divided into 3 groups only by separating the two vehicle bodies. Thus, desired vehicle bodies and vehicles can be obtained.

With the train of articulated vehicles, since the receiving side vehicle bodies each having one or s pair of receiving side articulating portions and the received side vehicle bodies each having one or a pair of received side articulating portions are disposed alternately, disassembly and assembly of the articulated vehicles can be performed very readily, and it is easy to perform rearrangement of or modification to the formation of the train.

Preferably, at least a pair of ones of the articulating trucks are driving articulating trucks on which one of the receiving side vehicle bodies is provided together with control equipment for the driving trucks. Thus, in a disassembling or assembling operation for maintenance, a main circuit for the control equipment need not be removed or mounted, which simplifies the disassembling and assembling operation.

The train of articulated vehicles may further comprise a third vehicle body disposed between one of the receiving side vehicle bodies and an adjacent one of the received side vehicle bodies and having at the opposite ends thereof a received side articulating portion and a receiving side articulating portion which are similar to the received side particular portions of the received side vehicle bodies and the receiving side particular portions of the receiving side vehicle bodies, respectively. The third vehicle body provides different couplings to the alternate arrangement of the receiving side vehicle bodies and the received side vehicle bodies and thus enhances the feasibility in rearrangement of the formation of the train.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
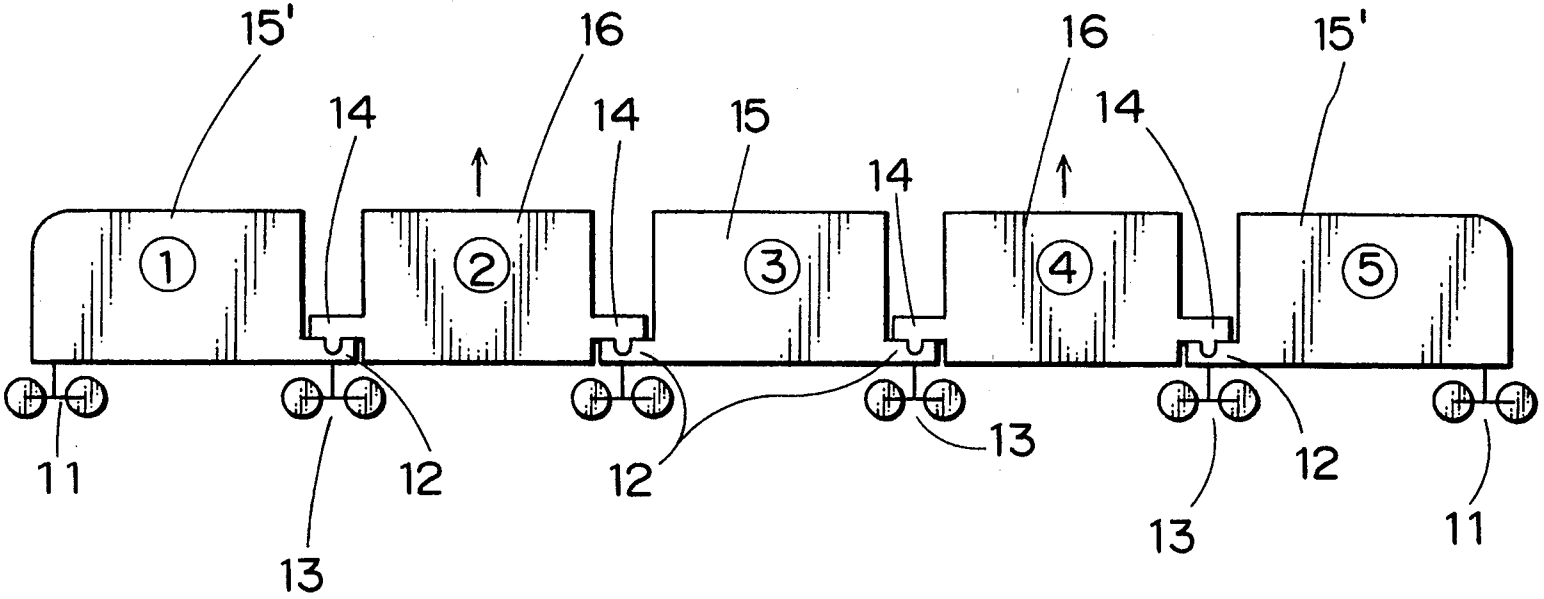
FIG. 1 is a schematic side elevational view of a train of articulated vehicles showing a first preferred embodiment of the present invention wherein a receiving side vehicle body is disposed as an odd-numbered vehicle.

Referring first to FIG. 1, there is shown a train of the formation of five vehicles to which the present invention is applied. The train shown includes three odd-numbered vehicles, that is, the first, third and fifth vehicles ①, ③ and ⑤ whose articulating portions are all formed as receiving side articulating portions 12 each supported on an articulating truck 13, and even-numbered vehicles, that is, the second and fourth vehicles ② and ④ whose articulating portions are all formed as received side articulating portions 14. Accordingly, each of the odd-numbered vehicles is supported either on an articulating truck 13 and a truck 11 for exclusive use or on a pair of articulating trucks 13, but each of the even-numbered vehicle bodies has no truck for the exclusive use at all. Thus, a vehicle body which has one or a pair of articulating portions each formed as a receiving side articulating portion 12 and has either an articulating truck 13 and a truck for the exclusive use or a pair of articulating trucks 11 13 such as the first, third or fifth vehicle ①, ③ or ⑤ in FIG. 1 is hereinafter referred to as receiving side vehicle body 15, and each of the second and fourth vehicle bodies ② and ④ which have no such articulating trucks 13 is hereinafter referred to as a received side vehicle body 16.

It is to be noted that particularly that one of the receiving side vehicles 15 which is disposed at the first or last end of the train such as the first or fifth vehicle body (1) or (5) is hereinafter referred to as receiving side end vehicle body 15'.

With the construction described above, if an even-numbered vehicle body is lifted upwardly in a horizontal posture as indicated by an arrow mark and disassembled from the vehicle bodies on the opposite front and rear sides thereof and then it is supported on a suitable truck or support table, the thus disassembled vehicle body and the resultant two trains of the other vehicle bodies forwardly and rearwardly of the disassembled vehicle body are separated from each other, and accordingly, they can be individually moved freely. In this instance, if only the even-numbered vehicle body is to be disassembled, then no adjacent odd-numbered vehicle body need be lifted. In the present train, only when an odd-numbered vehicle is to be disassembled, a pair of adjacent even-numbered vehicle bodies should be lifted.

Figure 2:
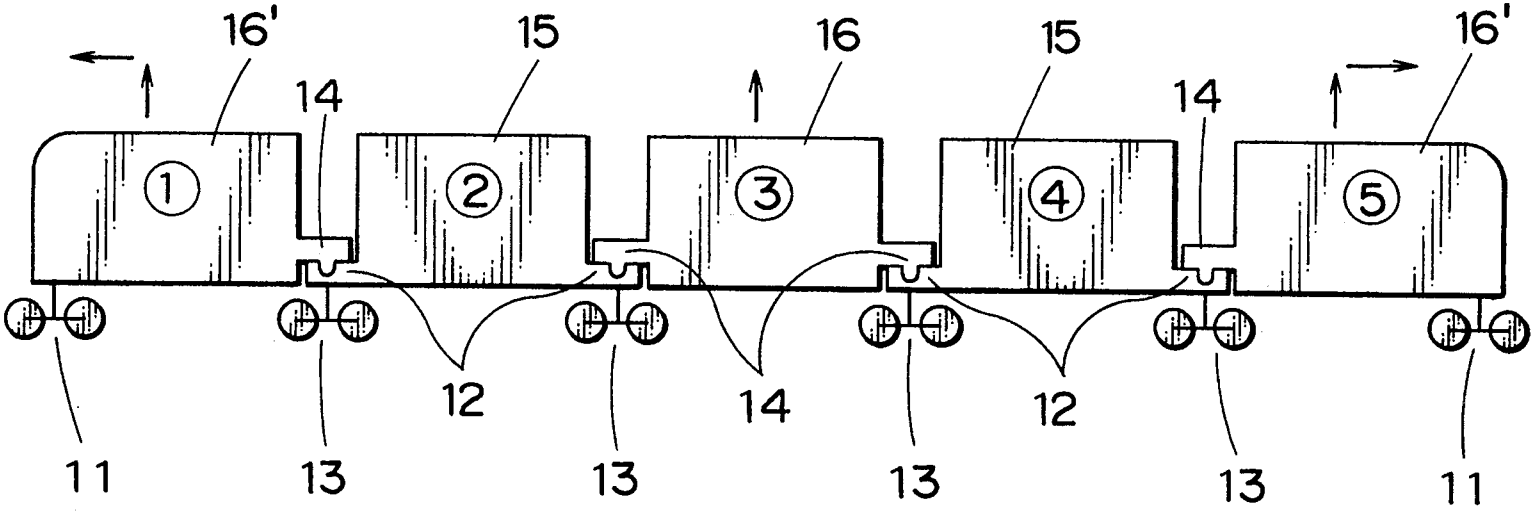
FIG. 2 is a similar view but showing a modification to the train of articulated vehicles of FIG. 1 wherein a received side vehicle body is disposed as an odd-numbered vehicle.

FIG. 2 shows another train of articulated vehicles to which the present invention is applied. The train of articulated vehicles is a modification to the train of articulated vehicles of FIG. 1 in that, contrary to the construction in FIG. 1, a pair of receiving side articulating portions 12 are formed at the leading and trailing ends of each of the evennumbered vehicle bodies (2) and (4) while a pair of received side articulating portions 14 are formed on the odd-numbered or third vehicle body (3). A received side articulating portion 14 is formed at each of the trailing end of the first vehicle (1) and the leading end of the fifth vehicle (5). The vehicle bodies of the second and fourth vehicles (2) and (4) serve as receiving side vehicle bodies 15, and the odd-number or first, third and fifth vehicles (1), (3) and (5) serve as received side vehicle bodies 16. The first and fifth vehicles (1) and (5) on the opposite ends of the train are each hereinafter referred to as received side end vehicle body 16'. With the construction of FIG. 2, when an oddnumbered vehicle is to be disassembled, adjacent evennumbered vehicles need not be lifted contrary to that in FIG. 1.

Figure 3:
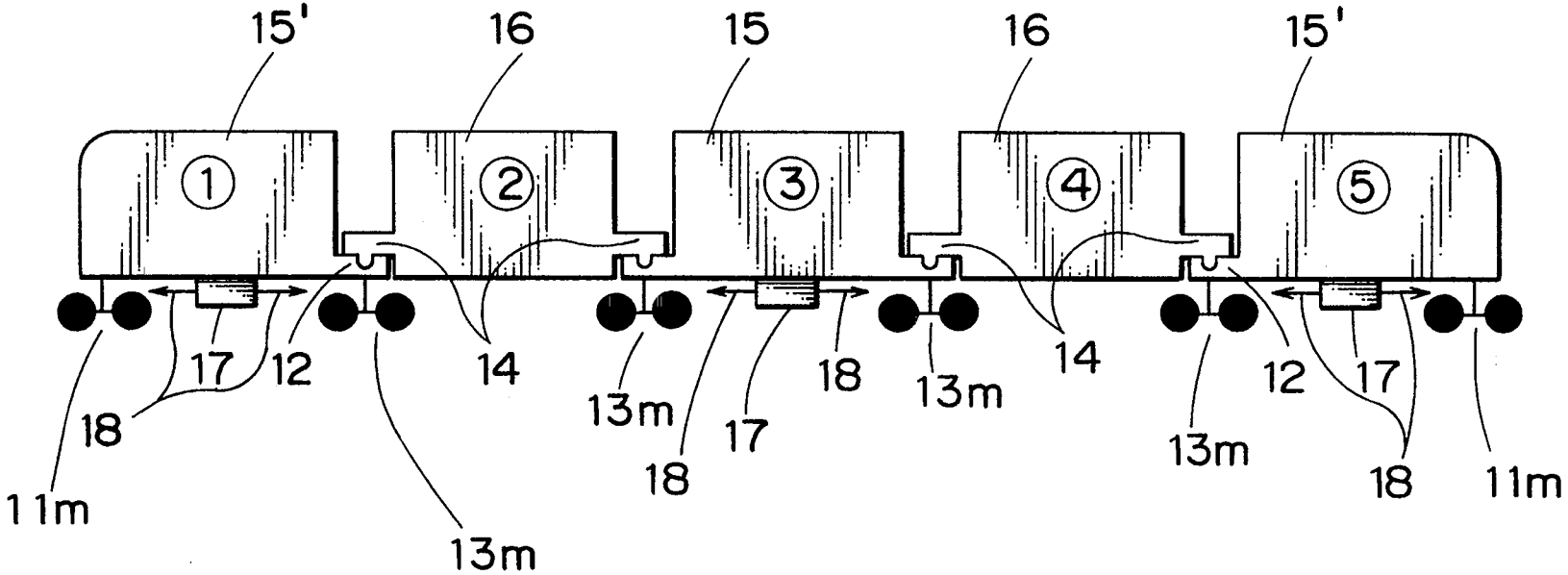
FIG. 3 is a similar view but showing another modification to the train of articulated vehicles of FIG. 1 wherein all trucks involved are formed as driving trucks and control equipments and main circuits for the driving trucks are provided on odd-numbered vehicles.

FIG. 3 shows a further train of articulated vehicles to which the present invention is applied. The present train of articulated vehicles is another modification to the train of articulated vehicles of FIG. 1 in that all of the trucks are formed as driving trucks 11*m* and 13*m*. In particular, each of the trucks 11*m* and 13*m*, for which wheels are inked in dark, has a driving motor (not shown) carried thereon. The driving motors provided on the trucks 11*m* to 13*m* are controlled by driving control equipments 17 each provided at a lower portion of a receiving side vehicle body 15 or a receiving side end vehicle body 15' for driving the train. In particular, each of the receiving side end vehicle bodies 15', that is, the first and fifth vehicle bodies (1) and (5) supported on and driven by a driving truck 13 and another driving truck 11 for the exclusive use, and the receiving side vehicle body 15, that is, the third vehicle body (3), is carried on and driven by a pair of driving trucks 13. Where the present construction is employed, since the control equipments 17 and the driving trucks 11*m* and 13*m* are all carried on the receiving side vehicle body 15 and receiving side end vehicle bodies 15', main circuits 18 which must necessarily be coupled individually to the driving motors can be wired on common vehicle bodies. For example, the main circuits 18 for the driving trucks 11*m* and 13*m* on which the first vehicle body (1) is carried are wired on the first vehicle body (1). Importantly, even when an articulation mechanism is to be separated, there is no need of disturbing any main circuit, for which normally the engaging and disengaging operation is particularly difficult.

Additionally, the combination of the driving trucks with the control equipment and the receiving side vehicle body or bodies or receiving side end vehicle bodies is an equivalent construction to the way non-articulated vehicles are employed conventionally. In short, the idea that, in conventionally available articulated vehicles, all vehicle bodies of a train except one vehicle have only one truck and are accompanied by inconvenience in movement at an inspecting site or a factory, is reversed. Moreover, it becomes possible to handle the greater part of vehicle bodies analogously to nonarticulated vehicles, and besides, even if all trucks are formed as driving trucks as shown in FIG. 3, control equipments and driving circuits for the driving trucks need not be provided on all of the vehicle bodies but may be provided at the receiving side vehicle body or bodies and receiving side end vehicle bodies.

Figure 4:
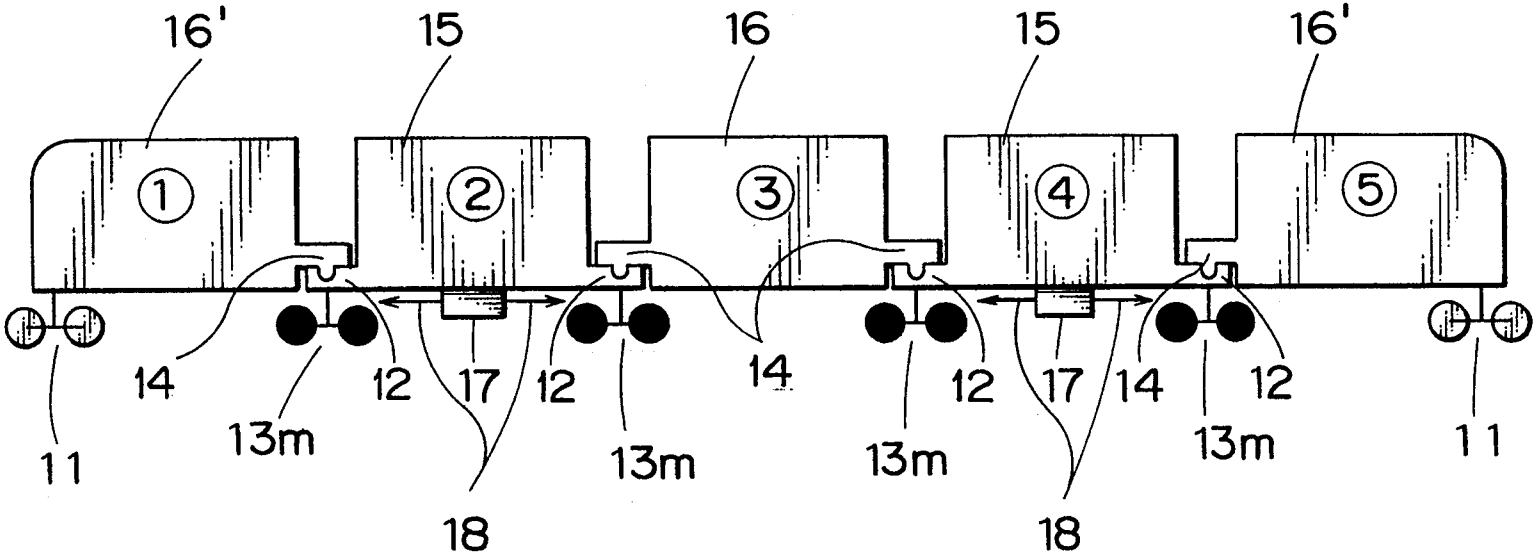
FIG. 4 is a similar view but showing a modification to the modified train of articulated vehicles of FIG. 3 wherein all trucks except those at the first and last ends of the train are formed as driving trucks and control equipments and main circuits for the driving trucks are provided on even-numbered vehicles.

FIG. 4 shows a modification to the modified train of articulated vehicles of FIG. 3 and also to the modified train of articulated vehicles of FIG. 2 in that each of the even-numbered vehicles serving as receiving side vehicles, i.e., the second and fourth vehicle bodies (2) and (4), is carried on a pair of driving trucks 13*m* and a control equipment 17 and a pair of main circuits 18, which are each coupled to a driving motor on a driving truck, are provided on each of the evennumbered vehicles. The trucks 11 at the first and last ends of the train have no motor carried thereon.

Figure 5:
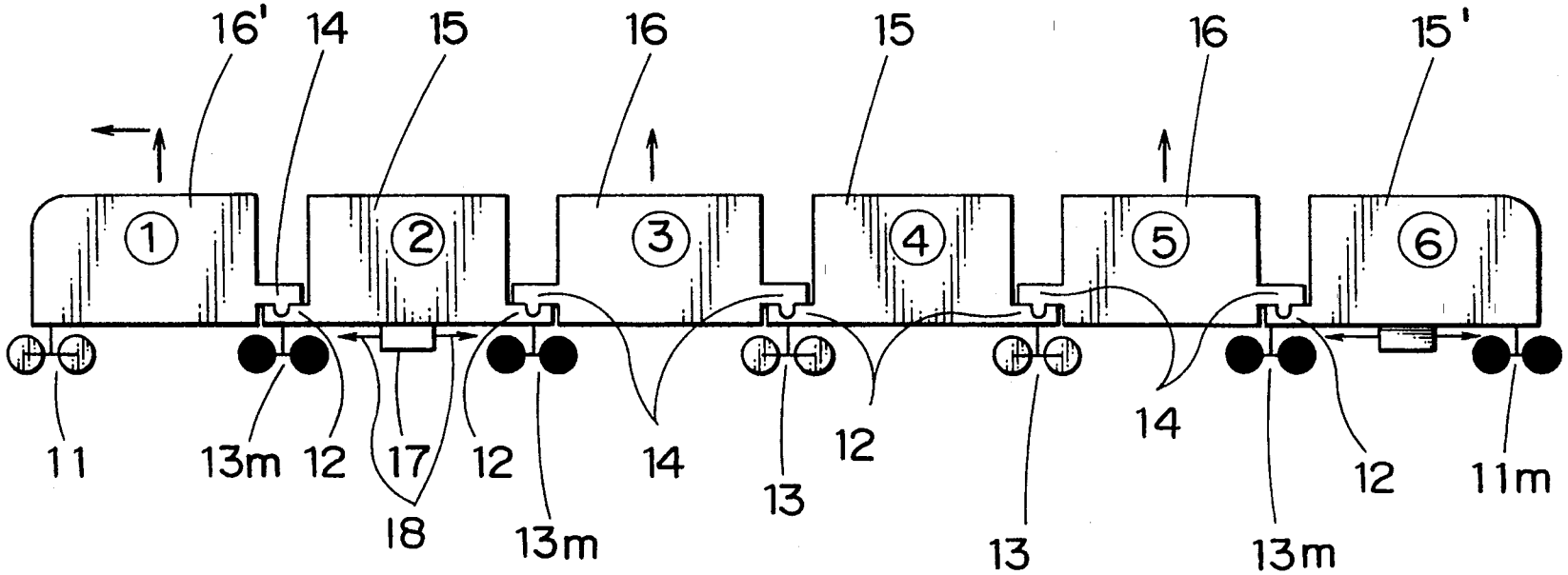
FIG. 5 is a similar view but showing another modification to the modified train of articulated vehicles of FIG. 3 wherein driving trucks are disposed for the second and last or sixth vehicles and control equipments and main circuits for the driving trucks are provided on the second and sixth vehicles.

FIG. 5 shows yet another train of articulated vehicles to which the present invention is applied. The train shown has the formation of a plurality Of evennumbered, six in the arrangement shown, articulated vehicles wherein the even-numbered articulated vehicles serve as receiving side articulated vehicles and is another modification to the modified train of articulated articles of FIG. 3 in that a control equipment 17 and a pair of main circuits 18 are provided on some of receiving side vehicle bodies, in short, on the second and sixth vehicles (2) and (6) but not on the fourth vehicle (4). The two trucks for the second vehicle (2) are formed as driving trucks 13*m*, and the two trucks for the sixth or last truck (6) are formed as a driving truck 13*m* and another driving truck 11*m* for the exclusive use.

Figure 6:
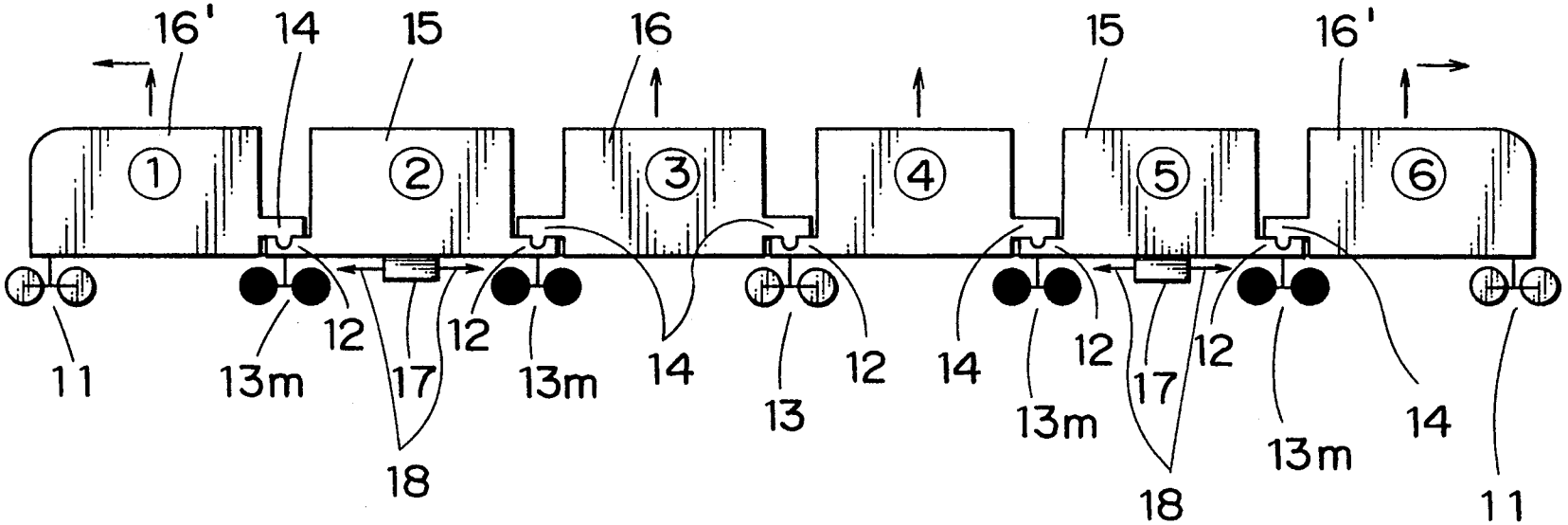
FIG. 6 is a similar view but showing a modification to the modified train of articulated vehicles of FIG. 5 wherein driving trucks and control equipments and main circuits for the driving trucks are provided on the second and fifth vehicles employing a vehicle body which has a receiving side articulating portion disposed at one end and a received side articulating portion disposed at the opposite end thereof.
Figure 7:
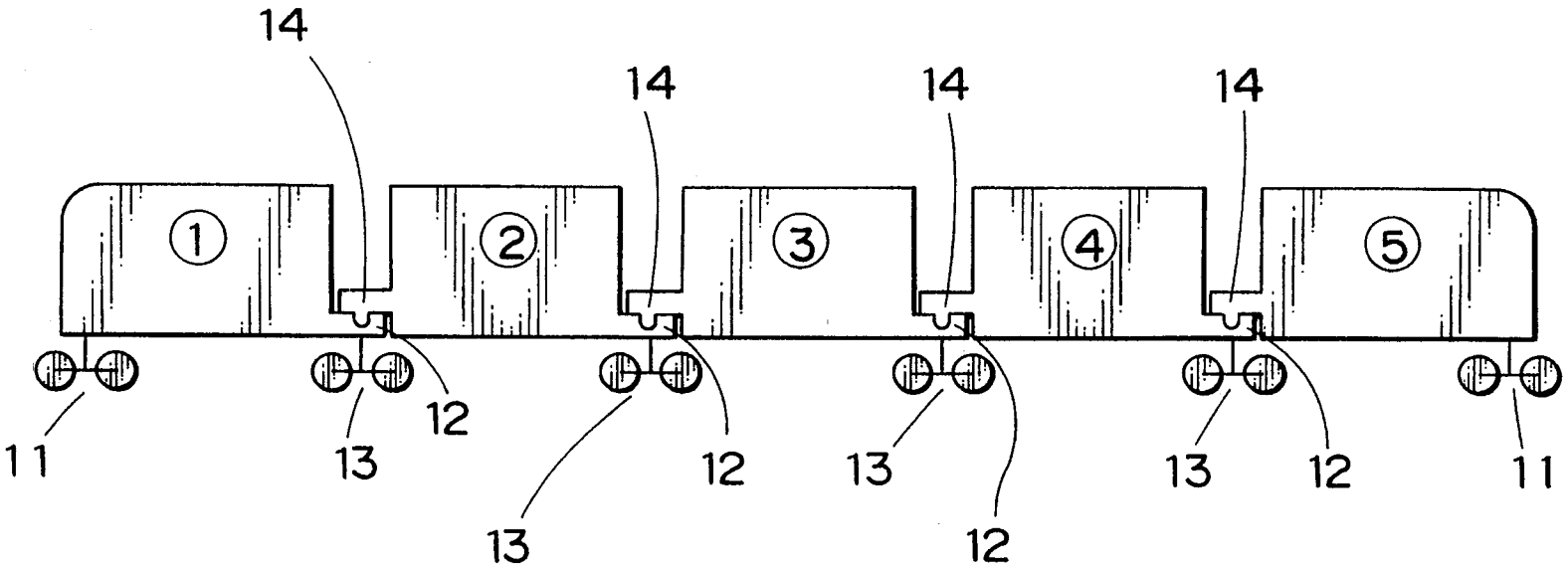
FIG. 7 PRIOR ART
FIG. 7 is a similar view but showing an exemplary conventional train of articulated vehicles.

FIG. 6 shows a modification to the modified train of articulated vehicles of FIG. 5 in that a control equipment 17 and a pair of main circuits 18 are provided on an even-numbered vehicle, that is, the second vehicle (2) and an odd-numbered vehicle, that is, the fifth vehicle (5), which are both formed as receiving side vehicle bodies. In the present arrangement, however, a vehicle body having a receiving side articulating portion 12 at an end thereof and having a received side articulating portion 14 at the other end thereof, which is a conventional vehicle body, is employed as the fourth vehicle (4). Where a vehicle body of the type just mentioned is prepared, a train which is suitable to separate, upon re-arrangement of the formation thereof, the train at a desired position and effect coupling to an articulating portion of the different type can be obtained.

Having now fully described the invention, will be apparent to one of ordinary skill in the art that many changes and modifications can be made thereto without departing from the spirit and scope of the invention as set forth herein.

What is claimed is:

1. A train of articulated vehicles, comprising:

a plurality of receiving side vehicle bodies each having at least one receiving side articulating portion;

at least one received side vehicle body having two received side articulating portions, said at least one received side vehicle body and said receiving side vehicle bodies being disposed alternately such that the two received side articulating portions are connected to the receiving side articulating portions of two different ones of the plurality of receiving side vehicle bodies, the receiving side vehicle bodies having articulating portions that are only receiving side articulating portions, and the at least one received side vehicle body having articulating portions that are only received side articulating portions; and a plurality of articulating trucks supporting each receiving side articulating portion such that the at least one received side vehicle body is only supported by two receiving side articulating portions.

2. The train of articulated vehicles of claim 1, further comprising at least two said received side vehicle bodies and a modified vehicle body disposed between one of said plurality of receiving side vehicle bodies and one of said received side vehicle bodies, said modified vehicle body having a received side articulating portion connected to the receiving side articulating portion of the one of the plurality of receiving side vehicle bodies and a receiving side articulating portion connected to the received side articulating portion of the one of the received side vehicle bodies.

3. The train of articulated vehicles of claim 1, wherein one of said plurality of receiving side vehicle bodies is a first end vehicle body and another one of said plurality of receiving side vehicle bodies is a second end vehicle body, said first end vehicle body including a first end truck on an end of said first end vehicle body opposite from the receiving side articulating portion of said first end vehicle body, said second end vehicle body including a second end truck on an end of said second end vehicle body opposite from the receiving side articulating portion of said second end vehicle body.

4. The train of articulated vehicles of claim 1, wherein at least one of said receiving side vehicle bodies is a control vehicle body, each control vehicle body having control equipment to control at least said articulating trucks of each respective control vehicle body.

5. A train of articulated vehicles, comprising:

at least one receiving side vehicle body having two receiving side articulating portions;

a plurality of received side vehicle bodies each having at least one received side articulating portion, a supported one of said plurality of received side vehicle bodies having two received side articulating portions, said at least one receiving side vehicle body and said received side vehicle bodies being disposed alternately such that the two receiving side articulating portions are connected to the received side articulating portions of two different ones of the plurality of received side vehicle bodies, the at least one receiving side vehicle body having articulating portions that are only receiving side articulating portions, and the received side vehicle bodies having articulating portions that are only received side articulating portions;

an additional vehicle body having at least one receiving side articulating portion connected to one of said received side articulating portions of said supported one of the plurality of received side vehicle bodies; and a plurality of articulating trucks supporting each receiving side articulating portion such that said supported one of the plurality of received side vehicle bodies is only supported by two receiving side articulating portions.

6. The train of articulated vehicles of claim 5, wherein one of said plurality of received side vehicle bodies is a first end vehicle body and said additional vehicle body is a second end vehicle body, said first end vehicle body including a first end truck on an end of said first end vehicle body opposite from the received side articulating portion of the first end vehicle body, said second end vehicle body including a second end truck on an end of said second end vehicle body opposite from the received side articulating portion of the second end vehicle body.

7. The train of articulated vehicles of claim 5, wherein at least one of said receiving side vehicle bodies is a control vehicle body, each control vehicle body including control equipment to control said articulating trucks of each respective control vehicle body.

8. The train of articulated vehicles of claim 5, further comprising at least two said receiving side vehicle bodies, wherein said additional vehicle body is a modified vehicle body disposed between one of said receiving side vehicle bodies and said supported one of said plurality of received side vehicle bodies, said modified vehicle body having a received side articulating portion connected to the receiving side articulating portion of the one of said receiving side vehicle bodies and the receiving side articulating portion connected to the received side articulating portion of the supported one of the plurality of received side vehicle bodies.

* * * * *